United States Patent [19]

Fleer

[11] 4,060,370

[45] Nov. 29, 1977

[54] MANIFOLD GAS VALVE WITH STEPPED FLOW OPERATION

[75] Inventor: Thomas P. Fleer, Sunset Hills, Mo.

[73] Assignee: Emerson Electric Co., St. Louis, Mo.

[21] Appl. No.: 721,022

[22] Filed: Sept. 7, 1976

Related U.S. Application Data

[62] Division of Ser. No. 618,901, Oct. 2, 1975, abandoned.

[51] Int. Cl.[2] ..... F23N 1/00; F16K 31/12

[52] U.S. Cl. ..... 431/62; 137/489.5; 137/495; 236/80 R; 431/54; 431/58

[58] Field of Search ..... 236/1 E, 80 R, 92 A; 137/489.5, 495, 66; 431/53, 54, 58, 62

[56] References Cited

U.S. PATENT DOCUMENTS

| | | | |
|---|---|---|---|
| 3,126,911 | 3/1964 | Galley | 137/495 |
| 3,300,174 | 1/1967 | Urban et al. | 236/92 A X |
| 3,354,901 | 11/1967 | Dietiker et al. | 137/495 |
| 3,552,430 | 1/1971 | Love | 137/495 |
| 3,721,263 | 3/1973 | Visos et al. | 137/495 |
| 3,749,120 | 7/1973 | Love et al. | 137/489.5 |

*Primary Examiner*—Martin P. Schwadron
*Assistant Examiner*—Richard Gerard
*Attorney, Agent, or Firm*—Charles E. Markham

[57] ABSTRACT

A manifold gas valve for controlling gas flow to a burner has a diaphragm operated main valve, an electrically operated control valve, and means to delay the application of gas pressure to the main valve operating diaphragm to effect a delayed opening of the main valve. Opening of the control valve permits an immediate flow of gas to the main burner and simultaneously admits the application of gas pressure to effect a delayed opening of the main valve. The immediate flow of gas to the burner, which occurs upon opening of the control valve, is sufficient to effect reliable and timely ignition and support combustion.

2 Claims, 2 Drawing Figures

10
12
14
16
17
18
20
22
24
26
28
29
30
32
34
36
38
40
42
44
46
48
50
51
51a
52
54
55
56
58
60
62
64
66
68
70
72
74
76
78
80
81
82
84
86
88
90
92
94
96
98
100
102
103
104
106
108
110
112
114
116
118
120
122
124
126
128
130
132
134
138
140
142
144
146
148
149
150
152

MANIFOLD GAS VALVE WITH STEPPED FLOW OPERATION

This application is a division of my pending application, Ser. No. 618,901, filed Oct. 2, 1975 and now abandoned.

This invention relates to manifold gas valves having a diaphragm operated main fuel supply valve in which an immediate flow of gas is provided to effect limited combustion at a burner and in which the full rated flow is delayed until sufficient air draft develops in the combustion chamber, as a result of the limited combustion, to support combustion of the full rated flow.

In many installations it has been found essential to the safe operation of gas burners, enclosed in relatively compact combustion chambers, to delay the full rated flow of gas to the burner when starting burner operation until sufficient draft through the combustion chamber has been developed by combustion of a lesser flow to support combustion of the full rated flow.

Numerous arrangements, called stepped opening and slow opening valves, have been proposed to delay the full rated flow of gas to the burner. Among these prior arrangements are those disclosed in U.S. Pat. Nos. 3,300,174, 3,354,901, 3,552,430, and 3,721,263, each of which provides for the stepped opening operation of a diaphragm operated main valve. While these arrangements function satisfactorily to accomplish the required delay, they add significantly to the cost of construction inasmuch as each requires the provision of a delayed action expansible chamber operative to effect a change in the value of the operating pressure applied to the main valve operating diaphragm.

It is an object of this invention to provide a manifold gas valve, having a diaphragm operated main valve, which includes a particularly simple and economical means operative to provide an immediate flow of gas to a burner to establish an initial limited combustion and to admit the full rated flow of gas to the burner after a brief delay.

A further object is to provide a manifold gas valve having a diaphragm operated main valve and a control valve which, when opened, permits the relatively slow application or build up of gas pressure on one side of the main valve operating diaphragm to effect delayed opening of the main valve and simultaneously permits an immediate flow of gas to the burner which is substantially less than the full rated flow which occurs when the main valve is open but is sufficient to insure reliable ignition.

Further objects and advantages will appear when reading the following description in connection with the accompanying drawings.

Figure 1:
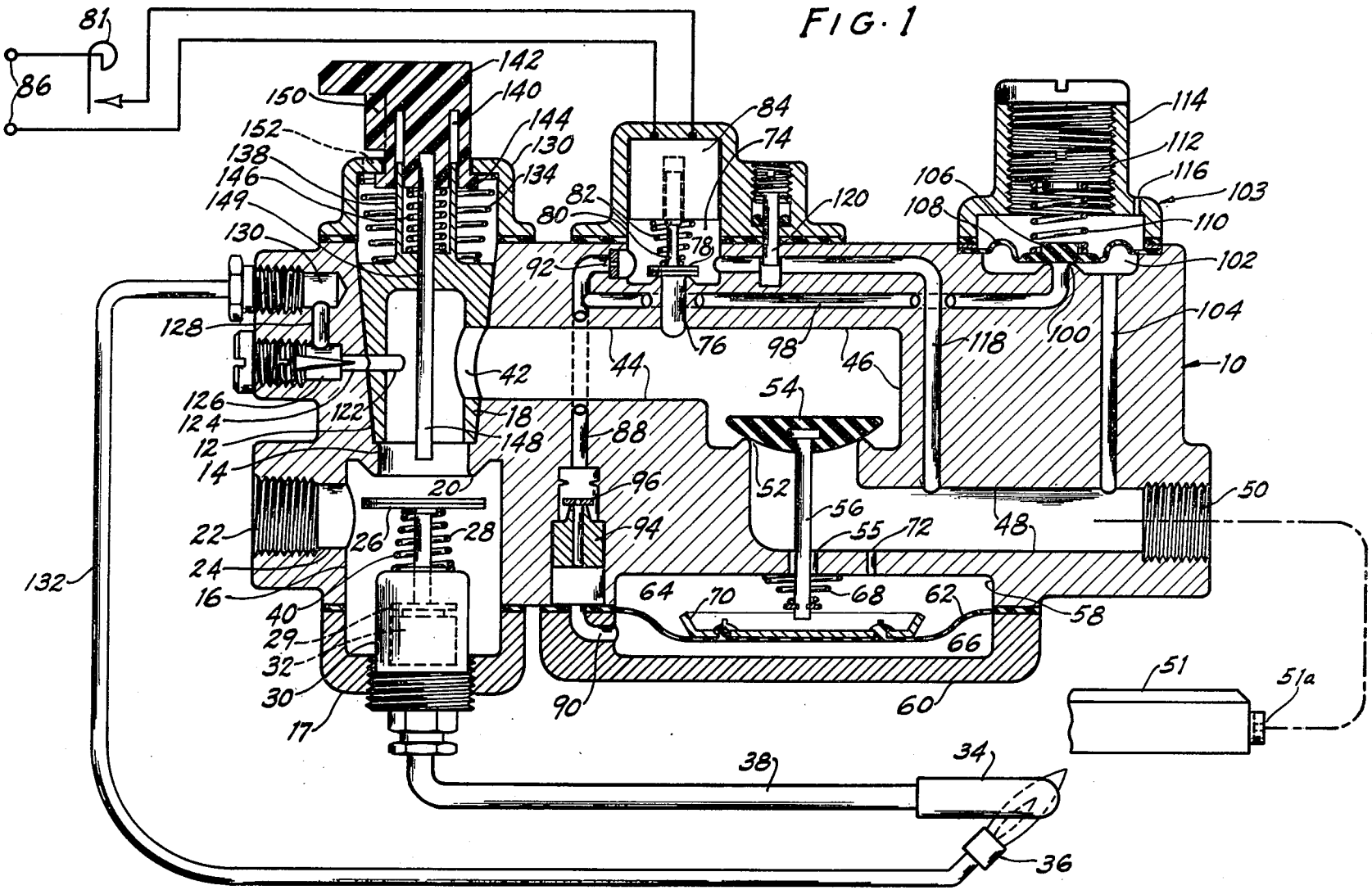
FIG. 1 is a cross-sectional view of a manifold gas valve constructed in accordance with the present invention, shown in association with a pilot burner and a main burner.

Referring to FIG. 1 of the drawings, the device comprises a body generally indicated at 10. The body 10 may consist of several sections joined together for convenience of casting or boring cavities and passages therein. In the drawing, however, the body is shown as an integrally formed structure, with all passages and cavities in the plane of the cross section so as to simplify the illustration.

The body 10 has a vertical bore therethrough comprising an upper tapered portion 12, an intermediate, reduced diameter, cylindrical portion 14, and a lower, enlarged diameter, cylindrical portion 16. A cover member 17 closes the lower end of the bore; a hollow, tapered, rotary plug valve 18 is seated in the tapered bore portion 12; and a valve seat 20 is formed at the lower end of the intermediate cylindrical portion 14. A horizontal inlet passage 24 leading from a screw-threaded inlet 22 intersects the lower bore portion 16 below the valve seat 20 and a safety cutoff valve 26 cooperates with valve seat 20. The valve 26 has a stem extending downward into a casing 30. Casing 30 is screw threaded into the cover member 17 and extends upward into bore portion 16. The casing 30 houses an electromagnet 32 which includes a core and winding. The electromagnet winding is energized by a thermocouple junction 34 connected to the winding by leads 38. Thermocouple 34 is positioned adjacent a pilot burner 36 and is heated by the pilot burner, whereby electromagnet 32 is energized.

The valve stem 28 has an armature 29 attached to its lower end and the valve 26 is biased in a closed position on seat 20 by a spring 40. The electromagnet does not have sufficient attractive force to move valve 26 from its seat to the open position shown. However, when valve 26 is moved downward manually until the armature 29 bears against the core of electromagnet 32, it will remain in this open attracted position so long as pilot flame exists to sufficiently heat the thermocouple junction 34.

The hollow plug valve 18 has a main burner fuel supply port 42 in the wall thereof adapted to register with a horizontal main fuel passage 44 leading to a main valve chamber 46. An outlet passage 48 leads from valve chamber 46 to a screw-threaded main burner outlet 50 from whence gas is conducted to a main burner 51 having a metering orifice 51*a*. An annular valve seat 52 is formed in valve chamber 46 around the end of outlet passage 48, and a main valve 54 cooperates with valve seat 52 to control the flow of gas from inlet 22 to main burner outlet 50. Inlet 22 is arranged to be connected to a source of fuel gas under pressure.

Valve 54 has a stem 56 extending downward through a bore 55 and into a main diaphragm chamber having an upper portion 64 formed as a recess 58 in the body 10 and a lower portion 66 formed by a cup-shaped member 60 attached to body 10. A flexible diaphragm 62 clamped at its periphery between body 10 and member 60 divides the diaphragm chamber into the upper and lower portions 64 and 66. Diaphragm 62 is herein referred to as the operating diaphragm or the main valve operating diaphragm.

The main valve 54 is biased closed on its seat 52 by a spring 68, and the diaphragm 62 has a relatively rigid, centrally positioned member 70 adapted to engage the valve stem 56 to move main valve 54 upward toward an open position when diaphragm 62 flexes upward due to an increase in pressure in lower diaphragm chamber 66. The member 70 provides weighting means biasing the diaphragm in a downward position spaced from engagement with valve stem 56 when the pressure in lower diaphragm chamber portion 66 is exhausted. The upper chamber portion 64 is freely vented to outlet passageway 48 through a vent 72.

There is a control valve chamber 74 formed in the upper portion of body 10 and a passage 76 connects chamber 74 with main fuel passage 44. A control valve 78 controls communication between passage 44 and chamber 74. The control valve 78 has a stem 80 and is biased closed by a spring 82. Valve 78 is opened by a solenoid 84 having a plunger to which valve stem 80 is connected. The winding of solenoid 84 is connected across power source terminals 86 through a space thermostat 81, so that when the thermostat contacts are closed control valve 78 is opened. Therefore, when control valve 78 is opened upon closure of thermostat 81, the control valve chamber 74 is in communication with inlet 22 via passage 44.

The lower portion 66 of the main diaphragm chamber communicates with control valve chamber 74 through operating pressure supply passages 88 and 90. There is a calibrated pressure dropping orifice 92 at the upper end of passage 88 and a check valve 94 at the lower end. Check valve 94 has a lightweight disc valve 96 having a small calibrated orifice therein which substantially slows the rate of gas flow downward into chamber 66, thereby to delay the pressure build up therein. Disc 96 moves off of its seat, however, to permit a more rapid upward flow from chamber portion 66.

That portion of operating pressure passage 88 between orifice 92 and check valve 94 is connected to outlet passage 48 via a passage 98, a valve seat 100, and the valve chamber 102 of a pressure regulator 103, and a passage 104. The valve seat 100 is formed in chamber 102 around the end of passage 98, and a pressure regulator valve 106 formed as a central part of a flexible diaphragm 108 cooperates with valve seat 100 to regulate the flow therethrough. The regulator valve 106 is biased closed by a spring 110 acting between the valve 106 and an adjustable nut 112 screw threaded into a cover member 114 attached to body member 10.

The periphery of pressure regulator diaphragm 108 is clamped between cover member 114 and body member 10. The upper side of diaphragm 108 is exposed to atmospheric pressure through a vent 116 in cover member 114. When the pressure in outlet passage 48 increases above atmospheric, this pressure increase is communicated to the underside of regulator diaphragm 108 through passage 104, and when the pressure increase is sufficient, the regulator valve 106 is moved off of its seat 100 against the bias of regulator spring 110.

An auxiliary fuel supply passage 118 leading from control valve chamber 74 to outlet passage 48 permits an immediate initial flow of gas to outlet 50 and thence to the main burner 51 when control valve 78 opens. This immediate initial flow through auxiliary passage 118 is sufficient to insure reliable ignition and sustained combustion at main burner 51. Preferably, auxiliary passage 118 is provided with suitable adjustable valve means 120, whereby the rate of the initial gas flow to the main burner may be varied so as to compensate for variations in the available supply pressure, the heat value of the gas, and the size of metering orifice 51*a* of main burner 51.

The hollow plug valve 18 is also provided with a circumferentially extending pilot burner fuel supply port 122 in the wall thereof adapted to register with a passage 124 in body 10. Passage 124, a chamber 126, a passage 128, an outlet passage 130, and a conduit 132 provide communication between the interior of hollow plug valve 18 and the pilot burner 36 when port 122 is in registry with passage 124. The port 122 extends sufficiently around the wall of plug valve 18 to permit registry of passage 124 therewith when the plug valve is rotated to an "on" position in which main port 42 and main passage 44 are in registry and, also, when the plug valve is rotated to a "pilot only" position in which main port 42 is not in registry with main passage 44. A manually adjustable needle valve in chamber 126 provides a means for adjusting the flow rate to the pilot burner.

The rotary plug valve 18 is urged downward into seating engagement in tapered bore 12 by a spring 134 biased between the upper end of plug valve 18 and a cover member 136 attached to body 10. The plug valve 18 is provided with a plurality of circularly arranged, integrally formed portions 138 extending upwardly from the upper end thereof. The portions 138 are slidably received in similarly circularly spaced, vertically extending slots 140 formed in an operating knob 142, whereby the plug valve 18 rotates with knob 142 and whereby knob 142 is free to move axially with respect to the plug valve. The knob 142 extends upwardly through an opening in cover member 136 and is movable vertically therein. A spring 146 biases the knob 142 upward and a flange 144 on the lower end of knob 142 limits its upward movement.

A rod 148 is attached to knob 142 and extends downwardly through a guide bore 149 in the upper part of plug valve 18. The rod 148 is arranged to engage cutoff valve 26 when knob 142 is depressed and to move it downward from a closed position on its seat 20 to an open position with the armature 29 in contact with the core of electromagnet 32. The knob 142 is also provided with a radial fin 150, and the cover member 136 is provided with an accommodating notch 152 which permits depression of the knob 142 to open cutoff valve 126 only when the plug valve 18 is rotated to a "pilot" position, in which position the fin 150 on knob 142 is in registry with the notch 152.

OPERATION

The device is shown in a ready position in the drawing. That is to say, the hollow plug valve is in "on" position in which fuel may flow from inlet 22 through main port 42 to the main valve chamber 46 and through port 122 to the pilot burner 136. Also, the pilot burner is burning and the cutoff valve 26 is held in open position by electromagnet 32. The space thermostat 81 is open, however, so that control valve 78 is closed, which prevents any flow of gas through passage 118 directly to main burner 51 or through passages 88 and 90 to the diaphragm chamber 66 to effect opening of main valve 54.

Under these conditions, when space thermostat 81 closes its contacts due to a drop in space temperature, the solenoid 84 is energized and the control valve 78 is opened rapidly. The opening of control valve 78 permits an immediate flow of gas to main burner 51 through auxiliary fuel passage 118 and outlet passage 48 which is sufficient to insure reliable ignition and sustained combustion when ignited by pilot burner 36. Simultaneously upon opening of valve 78, gas flows through orifice 92, operating pressure 88, the small orifice in check valve disc 96, and through passage 90 to the lower diaphragm chamber 66 at a relatively slow rate, so that the pressure in chamber 66 increases slowly to a value wherein diaphragm 62 is flexed upward into contact with main valve stem 56 and further upward against the bias of spring 68 to move main valve 54 openward sufficiently so as to provide, together with flow through auxiliary passage 118, the full rated flow of gas to burner 51. The elapsed time between the opening of control valve 78 and the sufficient opening of main valve 54 to provide the full rated flow to main burner 51 may be varied by varying the size of the small orifice in check valve disc 96.

That portion of the full rated flow which immediately passes through passage 118 to the main burner upon opening of control valve 78 may be varied to accommodate variations in the parameters of various installations, which effect main burner roll out, by adjusting valve means 120. For example, single port burners usually require a greater immediate initial flow than articulated or ribbon port burners to insure timely and reliable ignition and combustion. The range between a minimum immediate initial flow which will insure timely and reliable combustion and a maximum which would result in flame roll out is considerable. It is desirable, therefore, to provide an immediate initial flow which is substantially greater than the minimum required to insure timely and reliable combustion. It has been found that an immediate initial flow to the burner in the order of one-third the full rated flow will insure timely and reliable combustion and preclude flame roll out in most current, conventional installations.

The full rated flow of gas to burner 51 is maintained by the pressure regulator spring 110. When main valve 54 moves openward, the pressure in outlet passage 48 increases and this pressure increase is applied to the underside of pressure regulator diaphragm 108 through passage 104, causing pressure regulator valve 106 to be moved openward. Opening of regulator valve 106 causes a portion of the gas pressure in passage 88, which would otherwise be applied to the lower surface of main diaphragm 62, to be bled off to outlet passage 48. When main valve 54 is moved open to a position in which the pressure in outlet passage 48 attains a predetermined value, corresponding to the full rated flow, the regulator valve 106 opens to a position in which the bleed off of operating gas pressure from passage 88 occurs at a rate which will maintain this position of main valve 54.

That portion of the full rated flow which immediately flows through passage 118 to the burner upon opening of control valve 78 is not regulated per se. However, the full rated flow, of which this initial flow forms a part, is regulated. The immediate initial flow through passage 118 does, of course, of itself increase the pressure in outlet passage 48, but not sufficiently to effect opening of regulator valve 106.

When space thermostat 81 opens its contacts as a result of the space being heated sufficiently by burner 51, the control valve 78 immediatiately closes. This action cuts off the application of gas pressure to diaphragm chamber 66 and the flow of gas to burner 51 via the passage 118. Diaphragm chamber 66 now exhausts through passages 90, 88, and 118 to outlet passage 48, and main valve 54 closes under the bias of spring 68. The lightweight check valve disc 96 will be lifted from its seat as diaphragm chamber 66 exhausts, whereby the restricting orifice therein is bypassed. This permits a desirable rapid closure of main valve 54 and precludes pop back, which may otherwise occur in some type burners if the main valve is slowly closed.

The calibrated orifice 92 is operative to reduce inlet pressure to a value compatible with the parameters of the pressure regulating means and, of course, to some degree slows the build up in pressure in diaphragm chamber 66. However, it was found that when orifice 92 was made small enough to alone slow the pressure build up in diaphragm chamber 66 to a rate which would effect the required delayed opening of main valve 54 there was insufficient flow to achieve suitable regulation. Under these conditions, the regulator valve 106 fluttered because of insufficient flow through bleed-off passage 98. There is, therefore, a minimum size to which the control gas orifice 92 may be reduced while still retaining proper functioning of the pressure regulator, and this minimum size is yet too large to alone adequately restrict the flow to chamber 66 so as to attain the required delay. The purpose of orifice 92 is to effect a drop-in pressure below the supply pressure and establish an operating pressure and flow in passages 88 and 89 suited to design parameters of the device. Orifice 92 is therefore referred to herein as a pressure dropping restriction.

DESCRIPTION OF MODIFICATION IN FIG. 2

Figure 2:
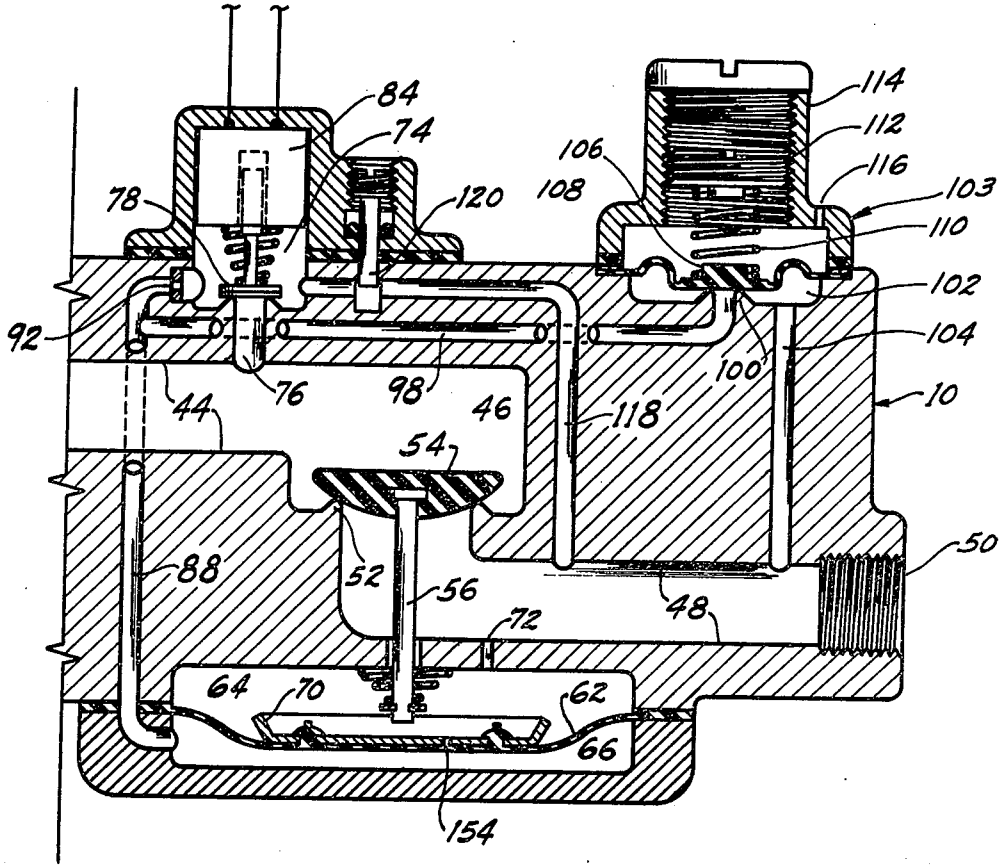
FIG. 2 is a fragmentary cross-sectional view of the manifold gas valve shown in FIG. 1, embodying a modified form of the means for delaying the opening of the main valve.

Referring to FIG. 2 of the drawings in which like numerals designate like elements, an alternate means for delaying the opening of main valve 54 is disclosed. In the arrangement of FIG. 2, the check valve 94 with restricting orifice disc 96 is omitted, and the passageway 88 extends from control valve chamber 74 and orifice 92 to the lower main diaphragm chamber portion 66. In lieu of the restricting orifice in check valve 96, a calibrated orifice 154 in member 70 with a suitable aligned aperture in diaphragm 62 is provided.

It will be apparent that orifice 154 functions to bleed off gas pressure from lower diaphragm chamber 66 to outlet passage 48 via vent 72 at a constant rate, thereby delaying the pressure build up in chamber 66 following opening of control valve 78. In this arrangement, orifice 92 may be made large enough to provide sufficient flow through regulator bleed-off passage 98, and the relative sizes of orifice 92 and orifice 154 are such that, following the opening of control valve 78, the pressure in chamber 66 will build up at a predetermined slow rate to a value sufficient to open valve 54 to a position wherein the full rated flow is attained. Operation of the device of FIG. 2 is similar to that of FIG. 1.

Obviously, a suitably restricted bleed-off passage extending from chamber 66 to outlet passage 48 through the body instead of through the diaphragm would achieve the same result. Other means of delaying sufficient pressure build up in chamber 66 will occur to those skilled in the art.

I claim:

1. In a gas valve device, a body member having an inlet for connection to a source of gas under pressure, an outlet for connection with a gas burner, main fuel passageway means connecting said inlet and outlet, and auxiliary fuel passageway means connecting said inlet and outlet, said main and auxiliary fuel passageway means jointly providing the full rated flow from said inlet to said outlet with said auxiliary passageway means alone providing sufficient fuel flow to support combustion at the burner, a biased closed main valve controlling flow through said main fuel passageway means, a flexible diaphragm forming the movable wall of an expansible chamber and operative upon expansion of said chamber to move said main valve openward, a normally closed control valve in said auxiliary passageway means controlling the flow therethrough, operating pressure passageway means leading from said auxiliary passageway means at a point downstream from said control valve to said expansible chamber, and means to retard the increase in pressure in said expansible chamber when said control valve is opened comprising a restricted flow passageway leading from said expansible chamber to said outlet providing a constant limited bleed off thereby to delay opening of said main valve.

2. In a gas valve device for controlling the flow of gas to a burner, a source of gas under pressure, a gas burner, said valve device comprising a body having an inlet for connection to said source, an outlet for connection to said burner, main fuel passageway means connecting said inlet and outlet, auxiliary fuel passageway means connecting said inlet and outlet, said main and auxiliary passageway means jointly providing the total flow from said inlet to said outlet and said auxiliary passageway means alone providing sufficient flow to support combustion at said burner, a biased closed main valve in said main passageway means controlling flow therethrough, a flexible diaphragm forming the movable wall of an expansible chamber and operative upon expansion of said chamber to engage said main valve and move it openward, a normally closed control valve in said auxiliary passageway means controlling flow therethrough, operating pressure passageway means leading from said auxiliary passageway at a point downstream from said control valve to said expansible chamber, and means for retarding the pressure increase in said expansible chamber when said control valve is opened comprising a restricting orifice in said operating pressure passageway means, and a restricted bleed-off passageway leading from said expansible chamber to said outlet providing a constant limited bleed off of pressure from said expansible chamber, thereby to delay opening of said main valve.

* * * * *